United States Patent [19]

White et al.

[11] Patent Number: 4,735,167

[45] Date of Patent: Apr. 5, 1988

[54] OFFSHORE MOORING/LOADING SYSTEM

[75] Inventors: Geoff C. White, Middlesex, England; Costas P. Manoudakis, Houston, Tex.

[73] Assignee: Brian Watt Associates, Inc., Pasadena, Calif.

[21] Appl. No.: 943,270

[22] PCT Filed: Jun. 3, 1985

[86] PCT No.: PCT/US85/01023

§ 371 Date: Dec. 17, 1986

§ 102(e) Date: Dec. 17, 1986

[87] PCT Pub. No.: WO86/07326

PCT Pub. Date: Dec. 18, 1986

[51] Int. Cl.[4] ..... B63B 21/00

[52] U.S. Cl. ..... 114/230; 141/387

[58] Field of Search ..... 114/230, 250; 141/192, 141/270, 284, 387, 388; 441/3-5

[56] References Cited

U.S. PATENT DOCUMENTS

| | | | |
|---|---|---|---|
| 3,661,170 | 5/1972 | Mitchell | 141/388 X |
| 4,114,556 | 9/1978 | Orndorff, Jr. et al. | 114/230 |
| 4,182,389 | 1/1980 | Guillaume et al. | 141/387 |
| 4,315,533 | 2/1982 | Eagles | 141/387 |
| 4,493,282 | 1/1985 | Ortloff | 114/230 |
| 4,494,475 | 1/1985 | Eribsen | 114/230 |
| 4,532,879 | 8/1985 | Ortloff | 114/230 |

OTHER PUBLICATIONS

"Cylindrical Semi Can Produce in 300-Meter Water Depths", *Offshore*, Jan., 1984, pp. 59 and 60.

"Offshore Loading Ready for Deepwater Fields", *Ocean Industry*, May, 1983, pp. 12-14.

"Assembly Set for Articulated Tower", *Offshore*, Apr. 1983, p. 138.

"Concrete Manotower for 600-ft Waters", *Ocean Industry*, Apr. 1983, pp. 143-145.

J. C. Bruce and K. J. Charpentier, "A Satellite Terminal System for the Artic", Offshore Technology Conference, May 1983.

*Primary Examiner*—Sherman D. Basinger

*Attorney, Agent, or Firm*—Pravel, Gambrell, Hewitt, Kimball & Krieger

[57] ABSTRACT

A mooring system for connecting a vessel having an opening in its bow, to a fixed non-compliant offshore structure allows the moored vessel to weathervane 360 degrees around the structure while it is being loaded or while it tranfers fluids back to the production structure. The mooring system includes an outer boom pivotally mounted to the structure and an inner boom slidably mounted to the outer boom. The inner boom has an inboard end slidably mounted within the outer boom and a curved outboard end extending beyond the inner boom and defining an opening. The assembly of the inner and outer boom is articulated so that it may be placed in contact with a mooring receptacle of the vessel so that the opening in the inner boom is adjacent to mooring receptacle of the vessel. An elongated mating link is retained by the inner boom and extends through the aligned openings in the inner and in the bow of the vessel. Upon extension the elongated mating link is rotatably mounted with respect to the longitudinal axis of the inner boom. Upon all vessel movements, the inner boom remains in contact with the mooring receptacle of the vessel due to the rotatable connection between the elongated mating link and the inner boom. A shock absorption system mounted with the inner and outer boom resists tensile and compressive forces in a direction parallel to the longitudinal axis of the inner boom exerted by the vessel on the inner boom.

38 Claims, 9 Drawing Sheets

OFFSHORE MOORING/LOADING SYSTEM

FIELD OF THE INVENTION

The field of the invention relates to offshore mooring/loading systems for temporarily moored tankers.

DESCRIPTION OF THE PRIOR ART

In the past, offshore mooring/loading systems for temporarily moored tankers were limited to operation in ice-free areas. These systems were mounted on compliant structures and all made use of conventional soft line mooring arrangements. These structures were usually single purpose loading terminals that required a separate production-storage facility and typically transferred the crude from the production to loading facilities through submerged pipelines or the like. The crude oil was transferred from the loading facility to the tanker via suspended or floating oil lines. One such system is discussed in the May 1983 issue of *Ocean Industry Magazine* on page 12.

There has been little development in designs for mooring/loading systems for arctic areas. One of the known designs for arctic use included a storage terminal structure having an oil handling apparatus mounted to the structure with a center swivel. This system was not useful for production platforms, since the topside equipment necessary for a production structure made the use of a 360° swivel impossible. Furthermore, even where such systems were practical they required a submarine pipe network from the production platform(s) to the terminal loading platform(s).

Other systems have included a suspended perimeter trolley oil delivery system for transferring crude from an oil producing terminal to a moored vessel. These systems are developed for ice-free areas. Although such systems enabled the tethered vessel to drift somewhat circumferentially about the oil production terminal, a full 360° weather vaning capability was not achieved. One inherent llmitation in such prior systems was due to the weight of the crude delivery hose when full of crude. Any systems which required paying out and taking up long lengths of hose filled with crude were limited by the capability of the equipment to deal with such great weight.

The known systems described employed a soft catenary mooring line rather than direct contact between a loading/mooring boom and the vessel to be loaded. The use of a soft mooring line limited the load capacity of the mooring systems and required the moored vessel to use continuous astern power to keep off the loading structure.

BACKGROUND OF THE INVENTION

The apparatus of the present invention is designed to facilitate the berthing and loading of a shuttle tanker from a fixed non-compliant offshore production/storage terminal, especially in a severe arctic environment. It is desirable to allow the connected tanker to weather vane without limit to either direction around the offshore production/storage terminal. By permitting the moored vessel to weather vane around the terminal the mooring loads are greatly reduced by taking advantage of the natural sheltering provided by the terminal structure. Furthermore, the telescoping boom arrangement of the present invention provides a compliant connection between the tanker and the platform to further reduce mooring loads by permitting first order motions of the tanker. First order motions are high frequency low amplitude oscillations of the tanker due to environmental conditions.

Typically, offshore bottom founded production/storage gravity structures designed for arctic service have a general conical profile below the water level and have base diameters as large as 600 feet and more. These structures may be placed in offshore locations with water depths of 60 feet or more. Typical ice capable tankers used to load crude oil from such production/storage terminals can be as long as 1,100 feet or more. The design of a mooring system must take into account the environmental conditions anticipated when ice conditions appear as well as open water conditions. Typically open water conditions are of a dynamic nature and tend to introduce large amplitude motions while the magnitude of the applied forces is relatively small. Ice conditions introduce large amplitude low frequency loading that results in higher stresses in the structure but introduces relatively little motion.

During open water conditions mooring forces are generated due to wave, current and wind loading on the mooring vessel. During the colder months the effect of ice on the moored vessel must be considered in the design of a mooring system. Empirical methods for calculating the loading of ice on vessels transiting through and ice field are known, as indicated by G. P. Vance "A Scaling System for Vessels Modeled in Ice" Society of Naval Architects and Marine Engineers, *Proceedings,* ICETECH 75, Montreal, Canada, April 1975. Analytical methods for calculating ice loads on vessels transiting through a broken or unbroken ice field are also known as indicated by V. R. Milano, "Variation of Ship/Ice Parameters on Ship Resistance to Continuous Motion in Ice" and "Ship Resistance to Continuous Motion in Ice" Society of Naval Architects and Marine Engineers, *Proceedings,* ICETECH 75, Montreal, Canada, April 1975. These methods have to be applied to moored vessels in an advancing ice field.

Taking into consideration the ice loads for an assumed ice thickness of fifteen feet as well as wind and current loads the apparatus of the present invention has been analyzed with an expected total tensile load on the boom of 4,600 kips applied along the centerline of the boom at an angle of inclination with the horizontal plane of twenty degrees maximum. Although the moored vessel will use astern power and/or side thrusters to the extent required to keep off the terminal structure, during transient conditions the vessel may apply some rideup load to the structure. The apparatus of the present invention is suited to handle rideup or compressive loads on the order of 1,000 kips and a side load of 500 kips.

The mooring/loading system of the present invention has the capability of year around unassisted mooring, demooring and loading of shuttle tankers to a fixed production structure. The system is capable of maintaining the shuttle tanker moored during open water or ice conditions. First order vessel motions including vessel surge are compensated for by the telescoping boom arrangement. The vessel is permitted to continuously weather vane around the production structure while loading crude uninterruptedly. The mooring and loading apparatus accommodates significant variation in the height of the ship-side mooring connection above the mean sea surface, provides automatic emergency decoupling of the mooring and loading system, and further maintains the mooring boom with the loading lines clear of the sea surface. The apparatus of the present invention allows the mooring equipment to be enclosed when not in use and further provides for tracing and heating of weather exposed surfaces for de-icing purposes. The mooring system provides compensation for movement in the horizontal and vertical planes with a minimum impact on the terminal structure to which it is connected. Finally, the mooring system of the present invention allows a safe and quick mooring/demooring procedure without assistance from service boats.

SUMMARY OF THE INVENTION

Briefly stated, the present invention provides a system for mooring a vessel having mooring receptacle to a fixed non-compliant offshore structure which permits the moored vessel to weather vane without limit in either direction around the structure while it is being loaded or while it transfers fluids back to the production structure. The mooring system includes an outer boom pivotally mounted to the structure and an inner boom slidably mounted within and extending from the outer boom. The inner and outer boom form a controlled, articulated assembly which permits an operator to place the boom in contact with the mooring receptacle of an offloading vessel, so that the inner boom is adjacent the mooring receptacle of the vessel suitably adapted to receive an elongated mating link. The interior of the inner boom defines a cavity through which fluid hoses and the like traverse. An elongated mating link is retained by the inner boom and extends through the aligned openings in the inner boom and in the bow of the vessel. The elongated mating link, when extended from the outboard end of the inner boom freely rotates with respect to the longitudinal axis of the inner boom. Thus, the inner boom remains in contact with the mooring receptacle of the vessel under all conditions due to the rotatable connection between the elongated mating link and the inner boom. A shock absorption system mounted with the inner and outer boom, in a direction parallel to the longitudinal axis of the inner boom, resists tensile and compressive forces exerted by the vessel on the inner boom. This system will exert increasing resistance with increasing movement of the inner boom from a mean position.

DETAILED DESCRIPTION OF THE PREFERRED EMBODIMENT

Figure 1:
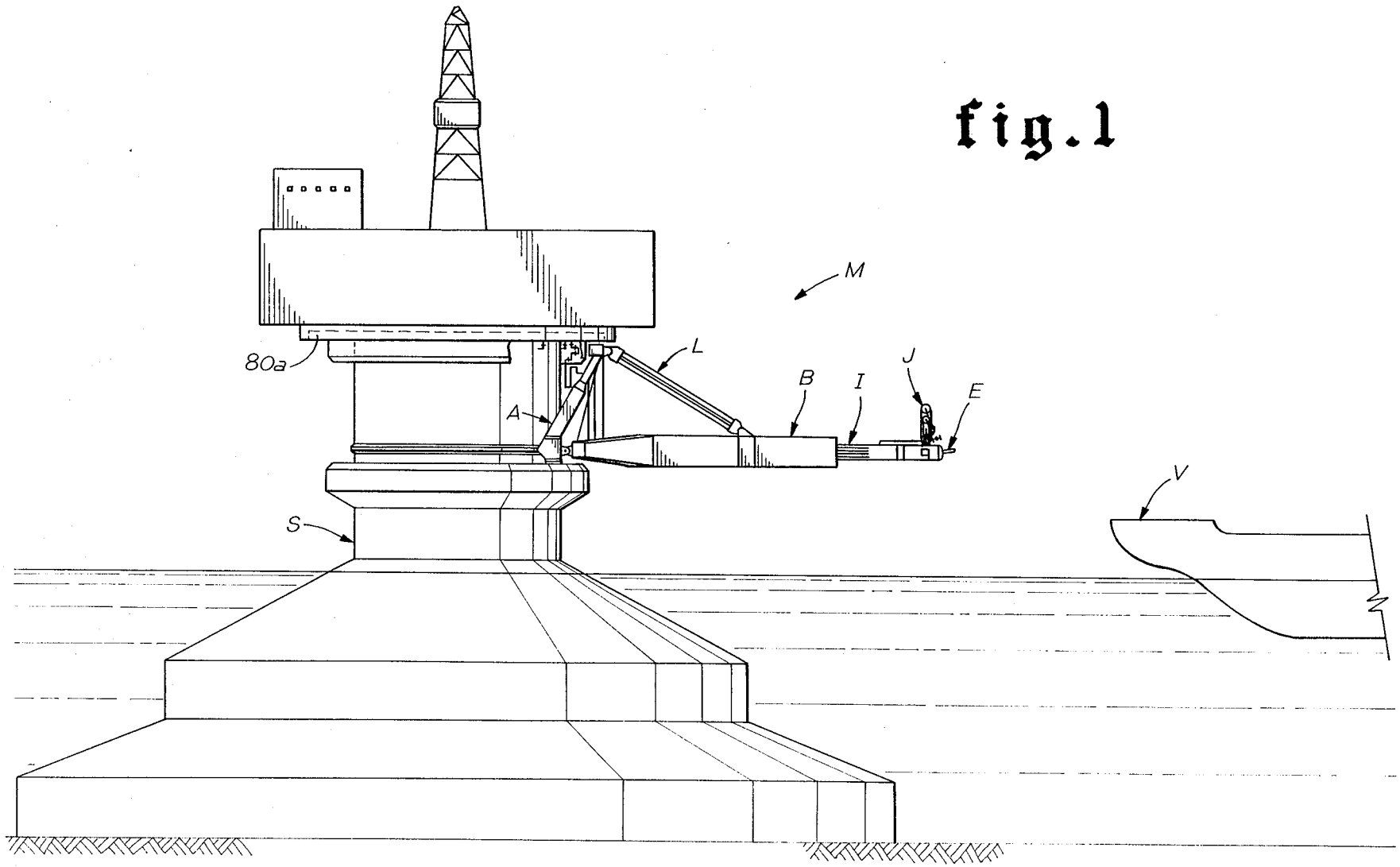
FIG. 1 is an overall elevational view of the offshore structure and the vessel illustrating the telescoping boom mounted to the offshore structure.

The mooring system apparatus M, as shown in FIG. 1, allows a vessel V to be moored to a fixed non-compliant offshore structure S. The mooring system M includes an outer boom B and an inner boom I adapted to telescope within outer boom B as will be more fully described hereinbelow. Outer boom B is pivotally mounted to A-frame A. A luffing means L is mounted to A-frame A and permits outer boom B to pivot in a substantially vertical plane as will be more fully described hereinbelow. Inner boom I further includes a mating link E pivotally mounted to the outboard end of boom I. A-frame A is mounted to the offshore structure S in a manner allowing vessel V to weather vane without a limit in either direction about offshore structure S when vessel V is connected to inner boom I via elongated mating link E, as will be more fully described hereinbelow.

Figure 6:
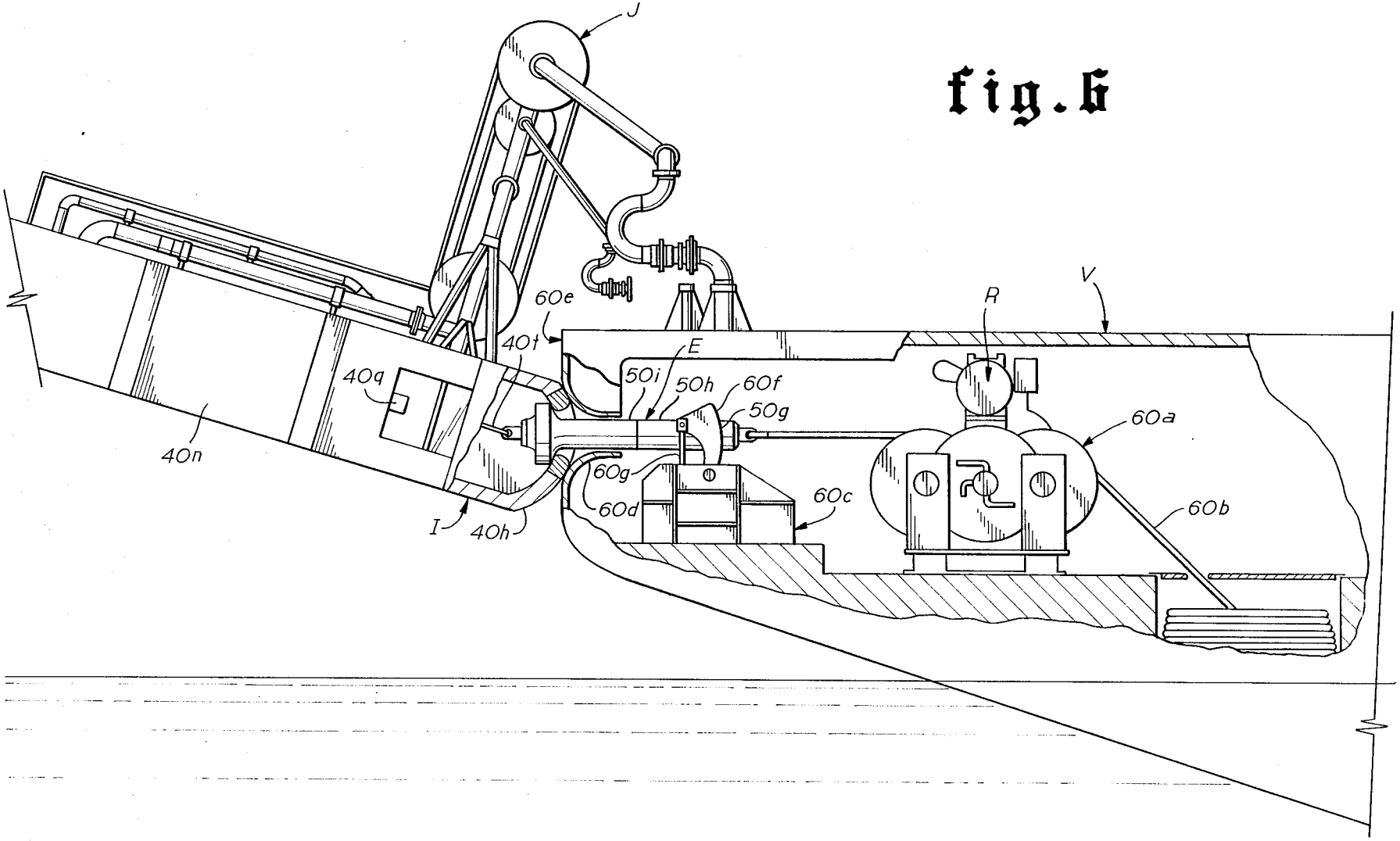
FIG. 6 is a cutaway sectional elevational view of the inner boom in contact with the bow of the vessel illustrating the facilities within the vessel for retaining the elongated mating link, and illustrating the loading arm on the inner boom for connecting the fluid loading lines and the fluid transfer lines from the inner boom to the vessel.
Figure 8:
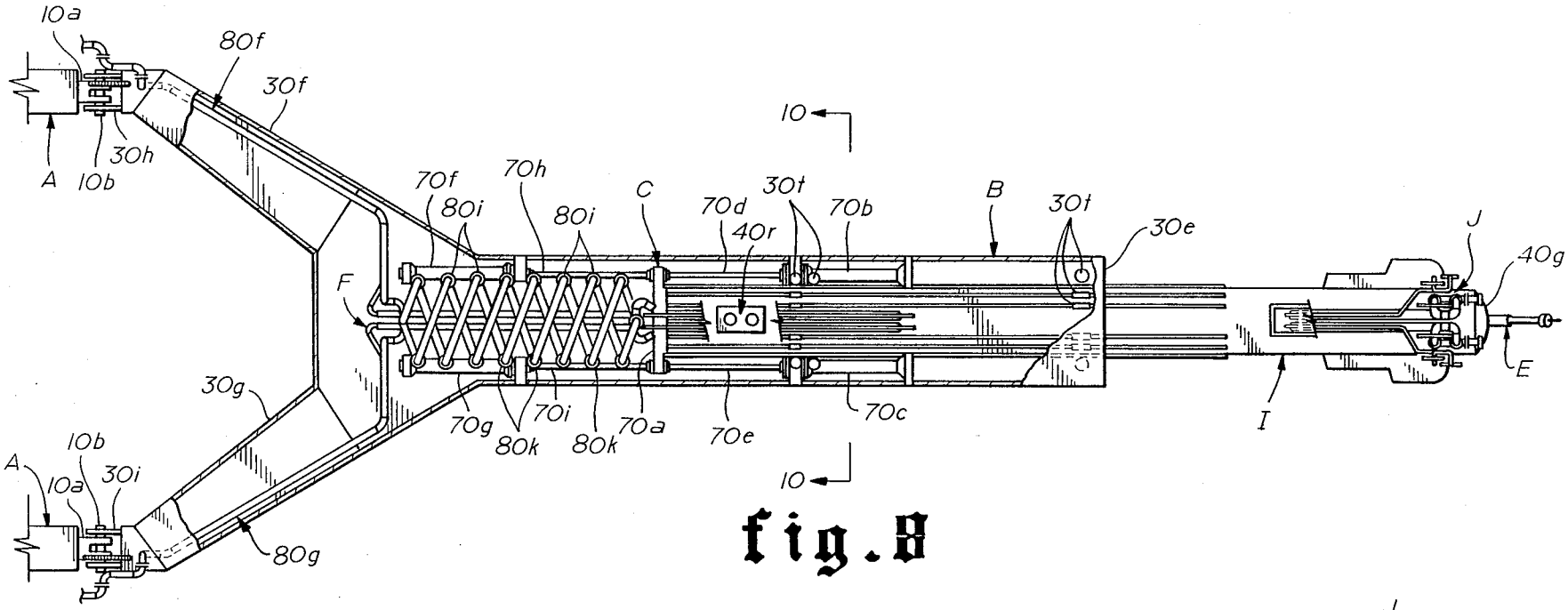
FIG. 8 is a part cutaway plan view of the inner boom disposed within the outer boom illustrating the support of the inner boom within the outer boom and the disposition of the fluid loading lines and the fluid transfer lines within the inner boom, outer boom and the A-frame.
Figure 9:
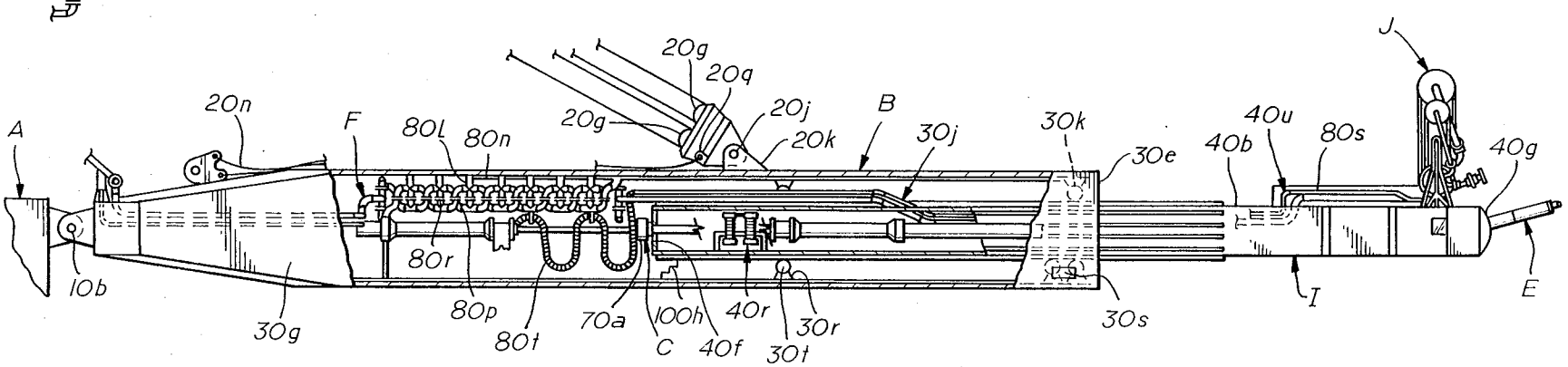
FIG. 9 is a part cutaway elevational view of the inner boom, outer boom and A-frame shown in FIG. 8.
Figure 11:
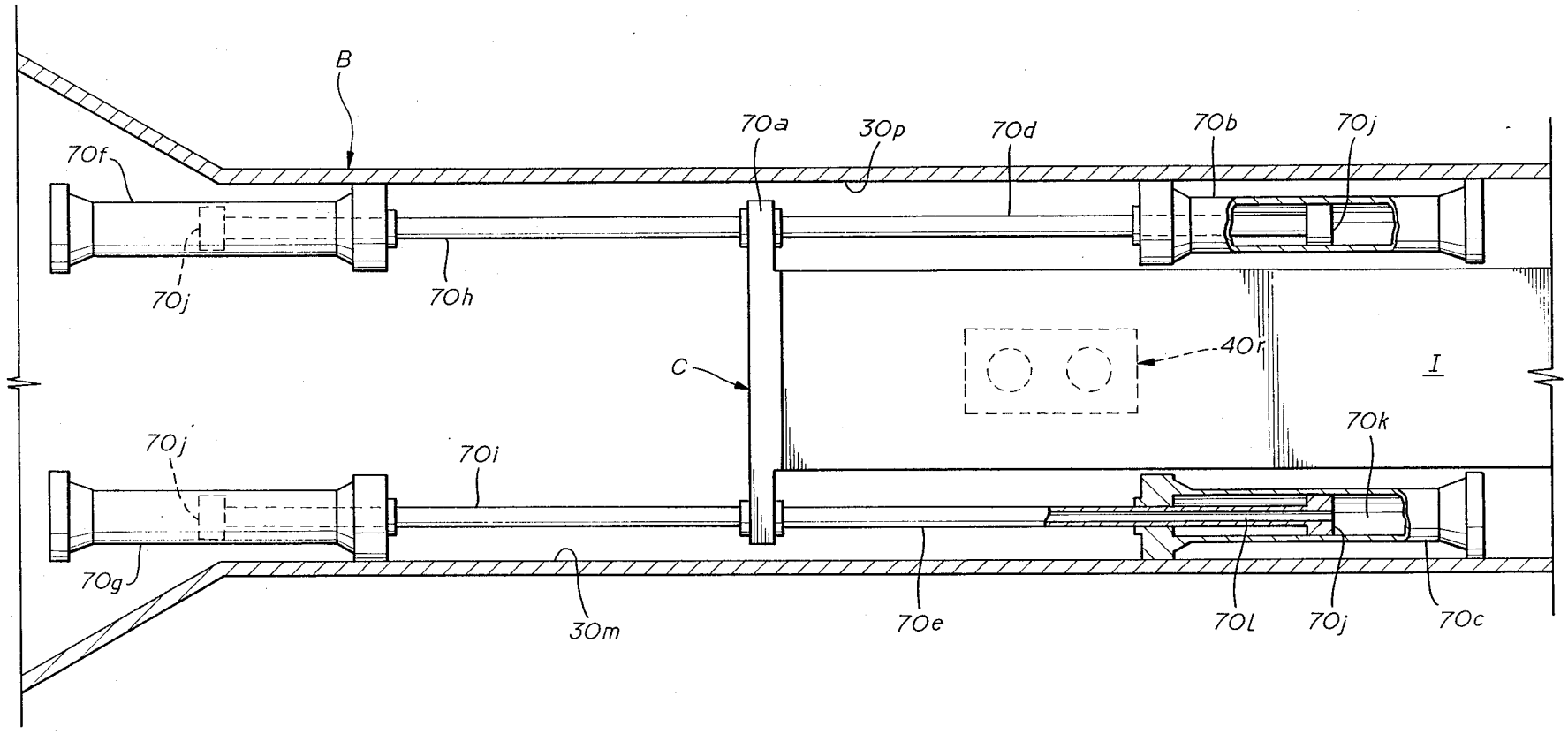
FIG. 11 is a detailed plan view of the shock absorbing system shown in FIG. 8.

Referring now to FIGS. 8, 9 and 11, system M includes a shock absorption means C to dampen tensile and compressive forces exerted along the longitudinal axis of inner boom I by vessel V, in the manner described below. A fluid transfer means F is provided (FIGS. 4, 9) to allow transfer of fluid in either direction from the offshore structure S to the vessel V. A releasable engagement means R is mounted on vessel V to retain elongated mating link E within the bow of vessel V. Accordingly, when releasable engagement means R retains elongated mating link E within the bow of vessel V, inner boom I is in contact with vessel V (FIG. 6). The pivotal connection between elongated mating link E and inner boom I allows inner boom I to remain in contact with vessel V despite all vessel movements.

Figure 2:
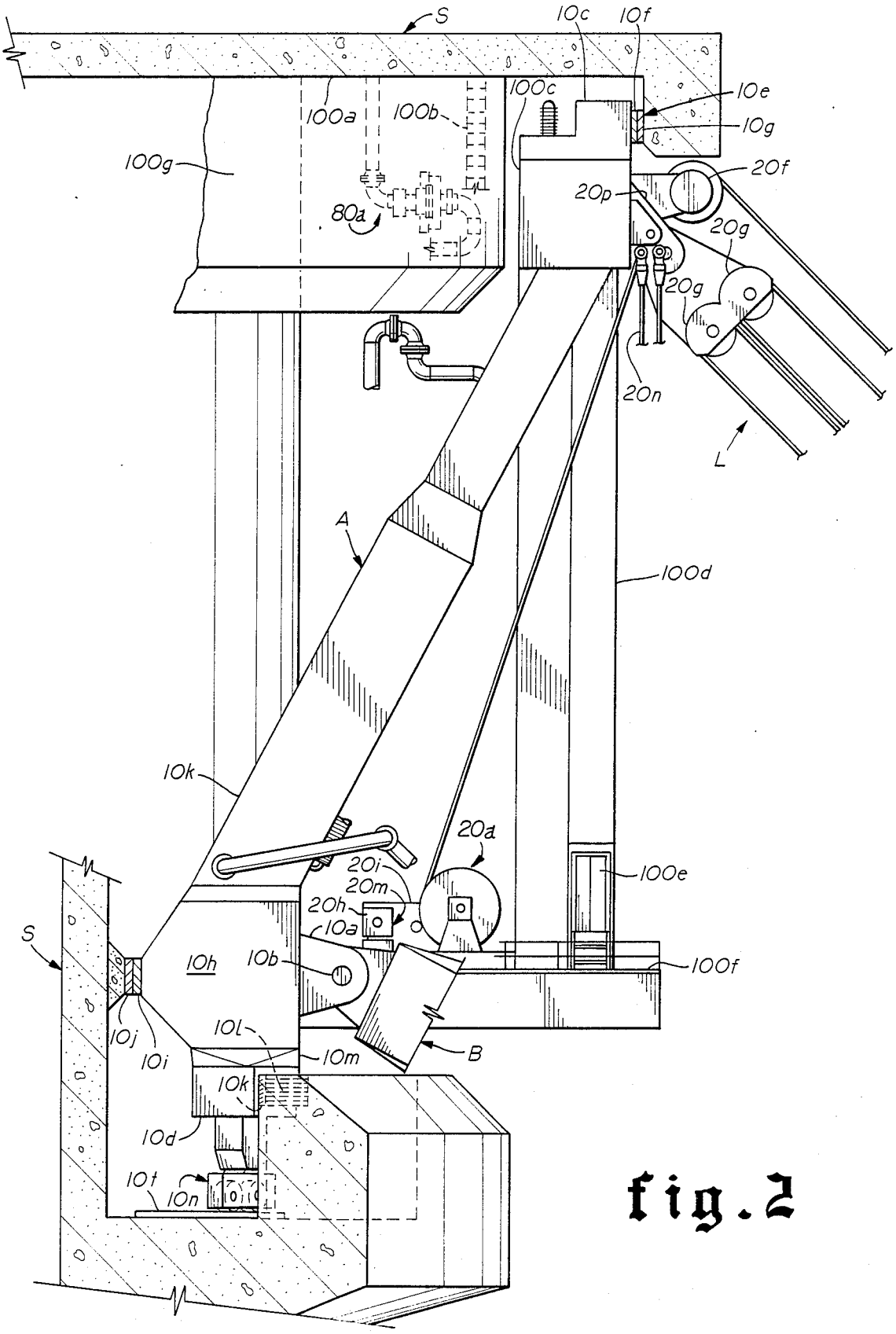
FIG. 2 is a partial side elevational view of the A-frame illustrating the location of the luffing apparatus thereon.
Figure 3:
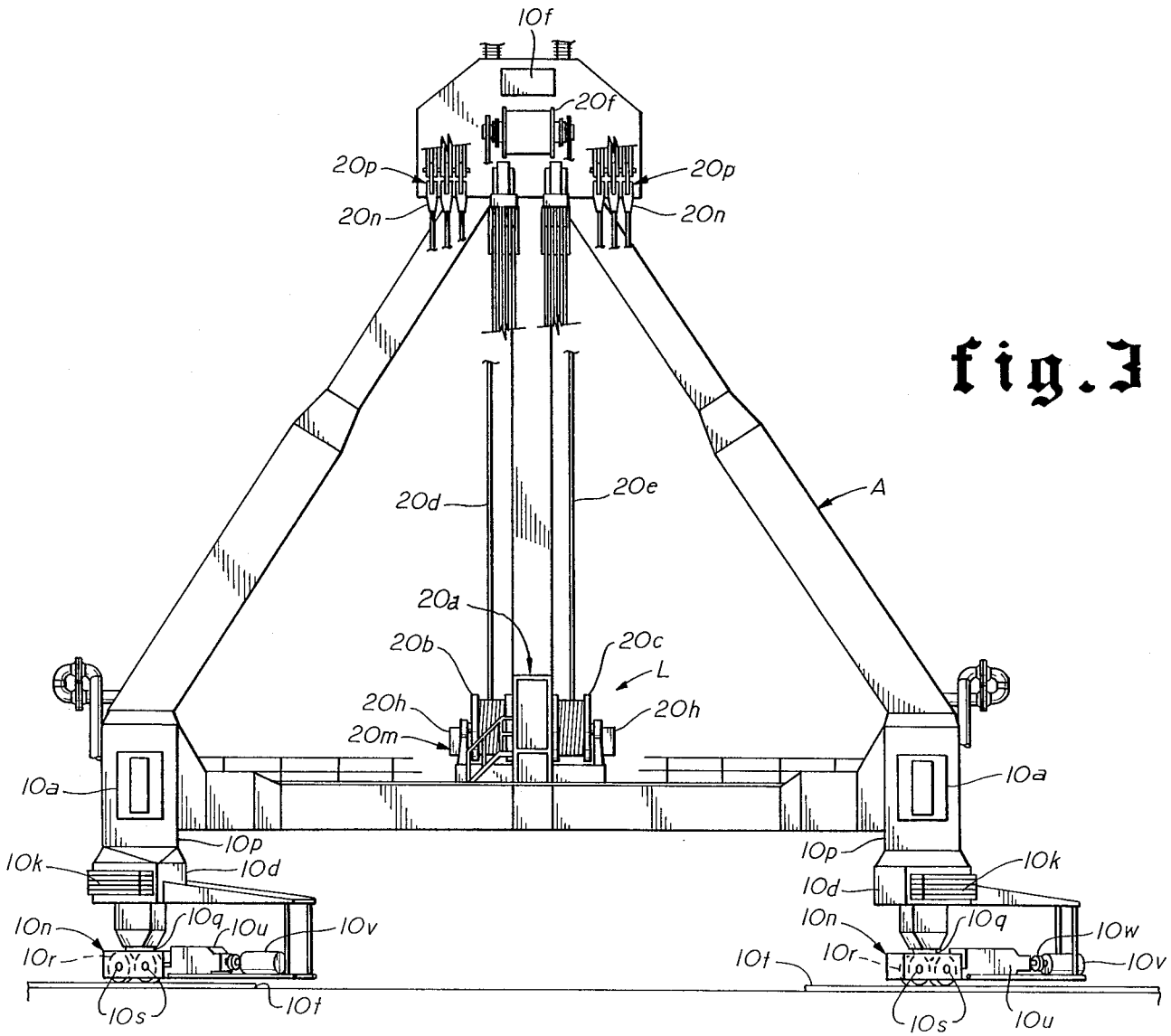
FIG. 3 is a front elevational view of the A-frame illustrating the position of the luffing winch and the driven bogies.

As seen in FIGS. 2 and 3, A-frame A is an enclosed box girder structure having a pair of mouting lugs **10*a* to facilitate the pivotal mounting of outer boom B via pin 10*b* mounted to lug 10*a*. A-frame A has an upper end 10*c* and a lower end 10*d*. A-frame A is supported horizontally from structure S by three annular lubrite bearing rings adjacent to the upper end 10*c*, the lower end 10*d* and location 10*h* of A-frame A. The upper and lower bearing rings respectively are denoted 10*e* and 10*l* on FIGS. 2 and 3. The bearing ring on location 10*h* is denoted as 10*j*. Attached to the A-frame A are a number of bearing pads resting against the three annular bearing rings. The upper bearing pad 10*f* rests againset bearing ring 10*e*. Two lower bearing pads 10*k* one on each leg of A-frame A rest against bearing ring 101**. Similarly, at the back of the A-frame A, bearing pads 10*i*, one on each A-frame leg, rest against bearing ring 10*j*. All bearing sections can be fabricated from a nickel aluminum bronze alloy having American Society of Testing Materials specification B148-C95500, however other bearing materials may be used without departing from the spirit of the invention. Additionally, roller bearings or bogies may be used without departing from the spirit of the invention. It is preferred that a lubricant, not shown, be present between the bearing surfaces. The lubricant should be specified for temperatures from minus one-hundred degrees Fahrenheit to four-hundred degrees Fahrenheit and preferably should be an epoxy base, graphite free material which will not promote electrolysis in seawater.

Moments imposed on the A-frame A exerted through pin 10*b* or luffing means L, as shown in FIG. 2, are resisted by the combination of upper continuous bearing ring 10*e* and the pair of lower bearing rings 10*l* and 10*j*. Bearing rings 10*e*, 10*l* and 10*j* additionally facllitate rotation of A-frame A about the vertical longitudinal axis of offshore structure S.

The weight of A-frame A along with the downward component of loads affecting A-frame A are transmitted to structure S via bogies 10*n*. Each leg 10*p* A-frame A (FIG. 3) is supported by a bogie 10*n*. Each bogie 10*n* is connected to the A-frame by a ball and socket bearing 10*q* thereby providing full articulation to insure equal wheel loading between the bogies 10*n* in support of A-frame A. The wheels 10*r* of each bogie 10*n* are of a special alloy cast steel running on antifriction bearings (not shown) mounted on a stationary shaft 10*s* secured to the bogie 10*n*. As shown in FIG. 2, wheels 10*r* on each bogie 10*n* have a flat face and run on an eighteen inch wide alloy steel rail arranged on a circular track 10*t*, for example. Circular track 10*t* is disposed in a substantially horizontal plane perpendicular to the longitudinal center line of offshore structure S. Although each bogie 10*n* is shown to have two wheels 10*r* mounted on two separate stationary shafts 10*s*, other configurations of wheels and shafts may be used without departing from the spirit of the invention. Each wheel 10*r* has a spur gear (not shown) which engages with a pinion (not shown) on the output shaft of a helical reduction gear 10*u* powered by a direct current traction motor 10*v* (FIG. 3). An electro-hydraulic brake (not shown) operates on the coupling 10*w* between the motor 10*v* and the helical reduction gear 10*u*. A clutch mechanism of a type known in the art is provlded with each bogie 10*n* so that the combination of helical reduction gear 10*u* and motor 10*v* with coupling 10*w* can selectively drive shafts 10*s* on each bogie to power A-frame A along circular track 10*t* to facilitate the mooring operation as will be discussed hereinbelow. Alternatively, a clutch mechanism (not shown), of a type known in the art, can decouple the drive means on each bogie (which comprises of reduction gear 10*u*, coupling 10*w* and motor 10*v*) from the spur gear (not shown) on each wheel 10*r* thereby allowing A-frame A to rotate about the longitudinal axis of offshore structure S due to the forces imposed by vessel V when it is connected to inner boom I, as will be more fully described hereinbelow. As seen in FIG. 2 bogies 10*n* are disposed beneath and between the pair of lower continuous bearing rings 10*j* and 10*l* in a radial direction measured from the longitudinal centerline of the offshore structure S.

As best seen in FIGS. 2, 3 and 9, luffing means L is mounted on A-frame A and permits outer boom B to pivot about pins 10*b* which connect outer boom B to A-frame A. Luffing means L includes a luffing winch 20*a* having twin cast wheel drums 20*b* and 20*c* with each drum 20*b* and 20*c* adapted to coil ropes 20*d* and 20*e*, respectively, in a multilayer fashion. It is understood that the luffing means L could employ hydraulic cylinders or other known devices instead of winch 20*h* without departing from the spirit of the invention. Each rope 20*d* and 20*e* passes over a load equalizing drum 20*f* (FIG. 3) before being wound up on drums 20*b* and 20*c*. In one embodiment, where the maximum capacity of the luffing system is 4,500 kips, ropes 20*d* and 20*e* consist of two inch diameter wire rope with each rope arranged in twenty-two falls using four rope pulley blocks 20*g* (FIGS. 2 and 9). Luffing winch 20*a* is driven by a pair of twin DC motors 20*h* (FIG. 3) which are connected in a known fashion with a reduction gear via flexible couplings. Alternating current can be used without departing from the sprit of the invention. A double jaw spring brake of a type known in the art (not shown) engages the coupling (not shown) between gear box 20*i* (FIG. 2) and motor 20*h*. The spring loaded brakes can be lifted by electro-hydraulic means or other means known in the art.

Motors 20*h* drive drums 20*b* and 20*c* at a fixed speed when a vessel is not connected to outer boom B. The gear box 20*i* is adapted to provide a direct drive or a four to one speed reduction between motors 20*h* and drums 20*b* and 20*c*. However, other speed ratios may be used without departing from the spirit of the invention.

The purpose of luffing system L is two-fold. When a boom I is not connected to a vessel V, luffing means L supports the weight of outer boom B and inner boom I via pin 20*j* (FIG. 9) connected to lug 20*k* at a point on top of outer boom B approximately two-thirds of the distance from pin 10*b* to the opposite end of outer boom B. Depending on operational requirements, luffing means L may be employed to raise and lower the assembly of outer boom B and inner boom I to facilitate the mooring of vessel V to inner boom I, as will be more fully described hereinbelow. In the event a vessel V is connected to inner boom I, the mooring boom will rotate about the pivot connection 10*b* as it follows the movement of vessel V. This movement will tend to slacken ropes 20*d* and 20*e*. Since such situations can overstress ropes 20*d* and 20*e* by suddenly applying a tensile force to a slack rope, it is desirable to maintain ropes 20*d* and 20*e* taut at all times that vessel V is connected to inner boom I. Accordingly, control means 20*m* (FIG. 2) mounted with motors 20*h* can be employed to regulate motors 20*h* to maintain ropes 20*d* and 20*e* taut in response to loads imposed by vessel V tending to slacken said ropes. Control means 20*m* varies the field excitation current to the DC shunt wound motors 20*h* which are controlled with conventional silicon controlled rectifier motor drives. Accordingly, by the variation of the excitation current, in a manner known in the art, the motor torque can be controlled to cause motors 20*h* to act as torque motors, maintaining a constant tension in the ropes 20*d* and 20*e*. Due to environmental conditions around the ship, and in order to maintain ropes 20*d* and 20*e* taut when the vessel is connected to inner boom I, it is preferred that motors 20*h* be capable of driving drums 20*b* and 20*c* at a speed of approximately four times the driven speed of drums 20*b* and 20*c* when a vessel V is not connected to inner boom I. Accordingly, it has been found that a maximum speed of motors 20*h* corresponding to a tip speed of the inner boom I of one-hundred feet per minute is adequate to maintain ropes 20*d* and 20*e* in a taut position when a vessel V is connected to inner boom I.

As shown in FIG. 9 a fixed length service cables 20*n* are normally stowed attached to outer boom B. In use (FIG. 3), service cables 20*n* are connected to the lugs 20*p* (FIGS. 2, 3) on one end and lugs 20*q* (FIG. 9) on the other end. With service cables 20*n* connected ropes 20*d* and 20*e* can be removed for maintenance or replacement. This feature can be significant in arctic environments due to the isolation of such facilities making it difficult to get service help quickly.

Figure 10:
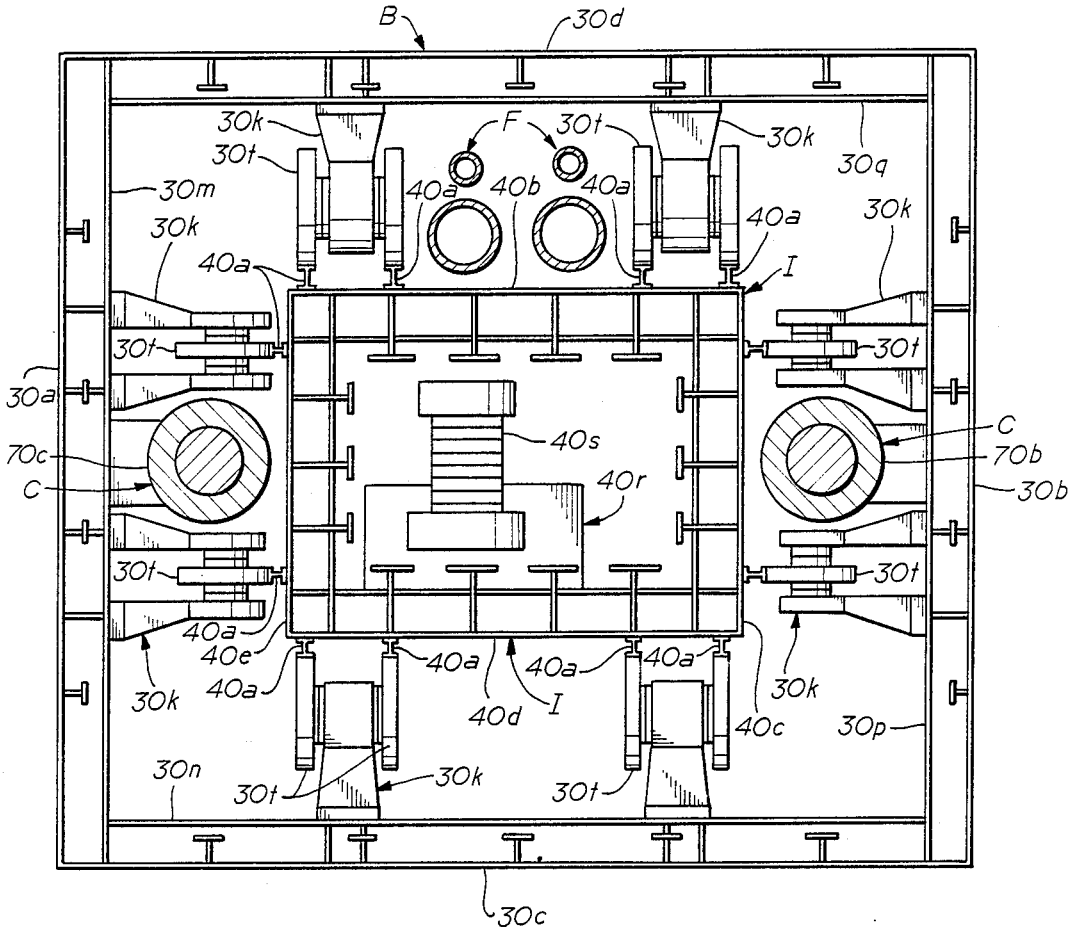
FIG. 10 is a sectional view taken along lines 10—10 of FIG. 8.

As seen in FIG. 2, outer boom B is pivotally mounted to pins 10*b* close to the lower end 10*d* of A-frame A. As best seen in FIGS. 8 and 10, outer boom B is an enclosed elongate structure having rectangular cross-section with vertical sides 30*a* and 30*b* and horizontal sides 30*c* and 30*d*. Outer boom B further has an outboard end 30*e* from which inner boom I telescopes. At the opposite end from outboard end 30*e*, outer boom B has a pair of legs 30*f* and 30*g*. Each leg 30*f* 30*g* has a rectangular cross-section and is a fabricated steel structure similar to the remainder of outer boom B. Leg 30*f* terminates in mounting lug 30*h* and leg 30*g* terminates in mounting lug 30*i*. Each of the pins 10*b* (FIG. 2) retains mounting lug 30*h* or 30*i* to one of the mounting lugs 10*a* on A-frame A. As shown in FIG. 9, fluid transfer means F extends throughout the interior of outer boom B from outboard end 30*e* to legs 30*f* and 30*g*. Fluid transfer means F emerges from legs 30*f* and 30*g* adjacent mounting lugs 30*h* and 30*i*, respectively. In FIG. 9, it can be seen that at position 30*j* within outer boom B, fluid transfer means F makes the transition from the interior of outer boom B to the interior of inner boom I through an orifice in the skin of inner boom I adapted for this purpose.

The telescoping action of inner boom I inside the outer boom B permits and compensates for surging motions of vessel V of the type that otherwise would impart tensile and compressive forces to A-frame A. In order to allow the inner boom I to telescope and resist the horizontal and vertical applied loads, a system of support rollers or bogies 30*k* (FIG. 10) is secured to inner walls 30*m*, *n*, *p* and *q*. Shock absorption means C is disposed along inner walls 30*m* and 30*p* between bogies 30*k* mounted to said walls. Fluid transfer means F is disposed between bogies 30*k* adjacent inner wall 30*q*. A plurality of parallel rails 40*a* are connected to outer surfaces 40*b*, *c*, *d* and *e* of inner boom I. The rails 40*a* may be placed in parallel pairs as shown on surfaces 40*b* and 40*d* or may be placed singly as shown on surfaces 40*c* and 40*e*. As shown in FIG. 9, bogies 30*k* are connected to outer boom B at two locations, inboard location 30*r* and outboard location 30*s*.

FIG. 10 illustrates the disposition of bogies 30*k* at inboard location 30*r*. Due to the presence of a lighter loading, bogies 30*k* on inner walls 30*m* and 30*p* each have a single axle and a single wheel 30*t*. Similarly, bogies 30*k* are mounted on inner walls 30*n* and 30*q* with each bogie 30*k* having a single axle with a pair of wheels 30*t* mounted thereon. The wheels located on 30*g* and 30*n* have fifty ton to thirty-eight ton capacity, respectively. As seen in FIG. 10 all the wheels 30*t* have flat face treads and are manufactured from cast carbon steel. Wheels 30*t* run on anti-friction bearings (not shown) carried in the bogie 30*k* frames. Each wheel 30*t* rides on a rail 40*a*. Inboard location 30*r* features single axle bogies mounted to inner walls 30*m* *n*, *p* and *q*, respectively, as shown in FIG. 10. However, at outboard location 30*s* the bogies 30*k* mounted to inner wall 30*n* have two axles with two fifty ton capacity wheels mounted to each axle. The additional axle and wheels are necessitated by the higher loads transmitted from the inner boom to the outer boom adjacent outboard end 30*e*.

Figure 7:
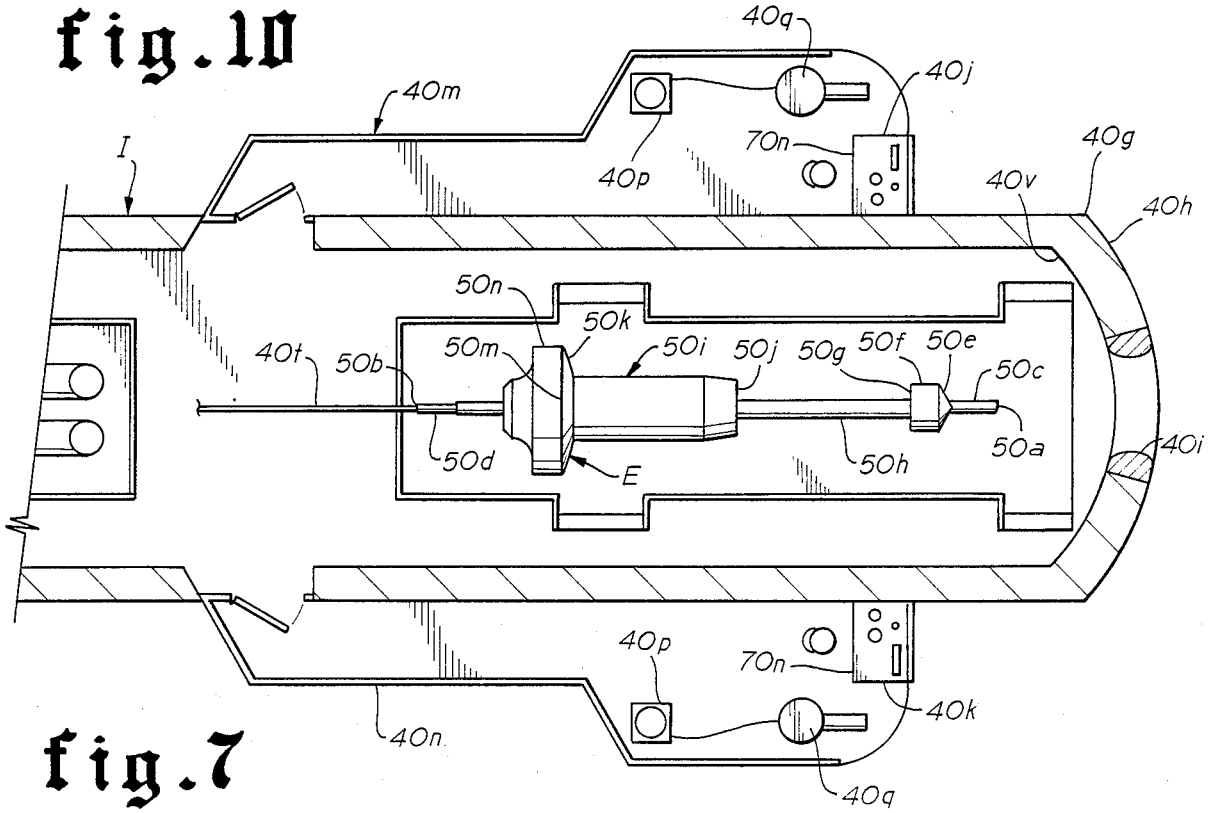
FIG. 7 is a cutaway plan view of the elongated mating link shown within the outboard end of the inner boom.

As seen in FIGS. 7 through 9, inner boom I is adapted to telescope within outer boom B. Inner boom I has an inboard end 40*f* (FIG. 9) and an outboard end 40*g*. As shown in FIG. 10, inner boom I has a rectangular cross-section with outer surfaces 40*b*, *c*, *d*, *e* describing its outer skin. Outboard end 40*g* has an arcuate surface 40*h* (FIG. 7) with an opening 40*i* whose center is aligned with the longitudinal center plane of inner boom I. Arcuate surface 40*h* permits boom I to smoothly interact with a corresponding receptacle on moored vessel V as will be more fully explained hereinbelow.

As shown in FIG. 7, inner boom I is an enclosed structure with a dual set of control centers 40*j* and 40*k* which can be used to monitor the mooring/loading operations. Control center 40*j* is located inside housing 40*m* and control center 40*k* is located inside housing 40*n*. A messenger line 40*p* used for establishing an initial line connection to vessel V may be stored in side housing 40*n* or in side housing 40*m*. A messenger line gun 40*q* may be stored in side housing 40*m* or side housing 40*n*. Messenger line gun 40*q* is portable and can be used to launch messenger line 40*p* through opening 40*i* to an awaiting vessel V to initlate the mooring procedure as will be more fully described hereinbelow. The messenger line 40*p* has a first end which may be connected inside inner boom I and a second end which is launched by messenger line gun 40*q* to the vessel V. As shown in FIG. 9, translation means 40*r* is located within inner boom I adjacent inboard end 40*f*. Translation means 40*r* includes a winch 40*s* (FIG. 10) and rope 40*t* (FIG. 7) which are used to retrieve messenger line 40*p* after the messenger line 40*p* has been shot with gun 40*q* to the vessel V. Messenger line 40*p* is used to bring in a pull in line 60*b* (FIG. 6) from the vessel V in accordance with the mooring procedure described hereinbelow. Translation means 40*r* is also used to pull elongated mating link E completely within inner boom I as shown in FIG. 7. Alternatively, using an idler pulley (not shown) located within inner boom I adjacent opening 40*i*, translation means 40*r* can be used to draw elongated mating link E through opening 40*i*.

As shown in FIG. 9, fluid transfer means F extends substantiallY within inner boom I from position 30*j* to position 40*u*, terminating on outer surface 40*b* of inner boom I at the loading arm means J. Loading arm means J is a marine loading arm which is fully powered for connecting fluid transfer means F to the piping aboard vessel V. Loading arm means J is of a type well known in the art and incorporates a plurality of swivel movements in perpendicular planes to allow alignment between the end of the fluid transfer means F and the ship board piping on vessel V. Typical of such marine loading arms is a device available from the Chiksan Division of Food Machinery Corporation under the designation of "fully powered RCMA". Fluid transfer means F is capable of simultaneously handling not only crude oil but gas and gas liquids through separate dedicated lines 80*f* and 80*g*.

Elongated mating link E has a first end 50*a* and a second end 50*b* (FIG. 7). Connection means 50*c* which preferably is a mounting eye is disposed adjacent first end 50a. Similarly, another connection means 50d which is also preferably a mounting eye is disposed adjacent second end 50b. Elongated mating link E is further defined by tapered surface 50e, annular surface 50f, and radial surface 50g. Radial surface 50g forms a step adjacent an engagement segment 50h which preferably has a rectangular cross-section. An elliptical section 50i is disposed adjacent engagement segment 5oh and defines a elliptical surface 50j therebetween. As will be more fully discussed hereinbelow, releasable engagement means R with the vessel V (FIG. 6) is adapted to engage elongated mating link E adjacent engagement segment 50h between step 50g and radial surface 50j. Section 50i has an elliptical cross-section to facilitate alignment of engagement segment 50h with the releasable engagement means R aboard the vessel V.

As previously stated, translation means 40r can be employed using rope 40t connected to connecting means 50d adjacent second end 50b to move first end 50a through opening 40i (FIG. 7 and FIG. 9). Elongated mating link E can move through opening 40i until spherical contact surface 50k disposed adjacent elliptical section 50i comes in contact with arcuate surface 40v inside inner boom I (FIG. 7). As shown in FIGS. 6 and 7, spherical contact surface 50k is defined by a cord 50m which is longer than the opening 40i thereby allowing elongated mating link E to be retained by inner boom I due to the interaction between spherical contact surface 50k and arcuate surface 40v. Accordingly, spherical contact surface 50k represents the outer travel stop of elongated mating link E as it moves through opening 40i. It should be noted that elliptical section 50i is mounted to spherical contact surface 50k in such a manner that the longitudinal axis of elliptical section 50i is disposed perpendicular to the plane of cord 50m. As can be seen in FIG. 6, elongated mounting link E is pivotally mounted with respect to inner boom I when spherical contact surface 50k engages arcuate surface 40v. Finally, elongated mating link E has a square cross-section 50n adjacent spherical contact surface 50k so that when elongated mating link E is stored fully within inner boom I it will remain therein without rolling from side to side.

As seen in FIG. 6, releasable engagement means R includes a traction winch 60a, a pull in line 60b, and a chain stopper 60c of a type known in the art. Pull in line 60b is operably connected to traction winch 60a for drawing the vessel V to inner boom I. In mooring the vessel V to inner boom I, messenger line 40p is shot over to vessel V via gun 40q. Alternatively, vessel V may pass at ninety degrees to the centerline of the longitudinal axis of inner boom I whereupon messenger line 40p may be dropped through opening 40i onto the deck of vessel V.

Having secured the messenger line 40p on the deck of vessel V, the messenger line is brought through opening 60d in the bow and deck of vessel V. The messenger line 40p is then connected to pull in line 60b. Traction winch 60a is employed to pay out pull in line 60b, while simultaneously, translation means 40r within inner boom I reels in messenger line 40p with pull in line 60b connected thereto. This procedure will prevent any of the lines from coming into contact with the water or the ice surface. When translation means 40r brings one end of pull in line 60b into inner boom I through opening 40i, the pull in line 60b is connected to connection means 50c adjacent first end 50a of elongated mating link E (see FIG. 7). With the pull in line 60b connected to connection means 50c on elongated mating link E, the traction winch can be operated to initially pull elongated mating link E through opening 40i until spherical contact surface 50k contacts arcuate surface 40v. Subsequently, upon further operation of traction winch 60a, vessel V will be drawn toward inner boom I. However, it is preferred that translation means 40r be employed after connecting pull in line 60b to connecting means 50c to initially move elongated mating link E until spherical contact surface 50k contacts arcuate surface 40v. Using translation means 40r to bring spherical contact surface 50k in contact with arcuate surface 40v avoids transmitting shocks to inner boom I by the sudden contact between spherical contact surface 50k and arcuate surface 40v. Additionally, if vessel V is not closely aligned with the longitudinal center line of inner boom I but is offset several degrees, traction winch 60a will not be able to pull elongated mating link E through opening 40i. Therefore, it is preferred that, upon bringing spherical contact surface 50k into contact with arcuate surface 40v using translation means 40r, traction winch 60a on vessel V be employed to reel in pull in line 60c thereby drawing bow 60e toward inner boom I. As previously described, luffing means L can be used to initially align opening 40i with opening 60d in vessel V before traction winch 60a is employed to draw vessel V toward inner boom I.

As seen in FIG. 6, elliptical section 50i interacts with the curved surface forming opening 60d to align square engagement segment 50h with pawls 60f connected to chain stopper 60c. Pawls 60f are hydraulically actuated by rods 60g. As shown in FIG. 6, each rod 60g selectively raises a pawl 60f adjacent square engagement section 50h until pawls 60f come in contact with step 50g (FIG. 7). Upon successful engagement between pawls 60f and elongated mating link E, pull in line 60b may be disconnected from elongated mating link E. Alternatively, the pull in rope 60b may be left connected to the mating link E, so to enable the vessel V and mooring boom I to reconnect easier after a temporary disengagement. With elongated mating link E secured within vessel V, arcuate surface 40h remains in contact with bow 60e despite any movement of the vessel V.

In the event a sudden disconnection is required between inner boom I and the vessel V, suitable controls, of a type known in the art, can be engaged to operate rods 60g to retract pawls 60f thereby allowing elongated mating link E to be withdrawn from bow 60e of vessel V upon astern movement of vessel V. Prior to this operation, fluid transfer means F would be disconnected from vessel V at loading arm means J.

When vessel V is connected to inner boom I, changing environmental conditions may cause vessel V to move toward or away from inner boom I. Such movement by vessel V exerts a component of force directed along the longitudinal axis of inner boom I. Similarly, when vessel V pulls away from inner boom I a tensile force having a component along the longitudinal axis of inner boom I is exerted on inner boom I by vessel V. To compensate for such tensile and compressive forces exerted on inner boom I by vessel V, shock absorption means C is disposed between inner boom I and outer boom O to dampen such sudden movements.

As shown in FIGS. 8, 9 and 11, a crosshead 70a is connected to inboard end 40f of inner boom I. A pair of single acting pneumatic cylinders 70b and 70f are connected to inner wall 30p. Similarly, a pair of single acting pneumatic cylinder 70c and 70g are connected to inner wall 30m (FIG. 10). Pneumatic cylinders 70b and 70c each have a piston rod 70d and 70e, respectively, extending therefrom. Piston rods 70d and 70e abutt crosshead 70a. Accordingly, upon application of a tensile force by vessel V on inner boom I, outward telescoping of inner boom I from outer boom B will be dampened by pneumatic cylinders 70b and 70c due to the interaction of crosshead 70a with piston rods 70d and 70e. Conversely, single acting pneumatic cylinders 70f and 70g (FIG. 8), which are secured to inner walls 30p and 30m of outer boom B will resist compressive forces applied by vessel V on inner boom I tending to telescope inner boom I into outer boom B, due to the interaction of piston rods 70h and 70i extending respectively from cylinders 70f and 70g and in contact with crosshead 70a.

As seen in FIG. 11, cylinders 70b, *c*, *f*, and *g*, each have a piston 70j mounted therein operably connected to the respective piston rod. In order to avoid the use of any external bank of air bottles to accumulate compressed gas 70k (disposed within cylinders 70b, *c*, *f* and *g* adjacent to their respective pistons 70j), each piston rod 70d, *e*, *h* and *i* is hollow defining a cavity 70l therein. The cavity 70l in each piston rod communicates with the fluid on the opposite side of the piston so that upon movement of crosshead 70a, the compressed gas 70k can flow into cavity 70l. Utilization of the volume of cavity 70l in this manner, eliminates the need for an external bank of pressure vessels or bottles for storage of the compressed gas 70k.

It should be noted that upon application of a tensile force by the vessel V on inner boom I which results in movement of crosshead 70a toward outboard end 30e of outer boom B, piston rods 70h and 70i will be disengaged from crosshead 70a. Similarly upon application of a compressive force by vessel V on inner boom I which results in movement of crosshead 70a toward legs 30f and 30g, piston rods 70d and 70e will not be in contact with crosshead 70a. Control means 70n can be located in control center 40k (FIG. 7) or aboard offshore structure S (not shown) for monitoring the operation of shock absorber means C. Control means 70n applies a preload of pneumatic pressure to all of cylinders 70b, 70c, 70f and 70g so that no movement of the crosshead can take place until a sustained tensile or compressive force of around one hundred tons is imposed by the vessel V on inner boom I. Thus both the pretension and damping of the mooring system can be continuously adjusted with control means 70n. Control system C employs conventional mechanical and electrical control components to accomplish the control function, and any suitable conventional control components may be used. Control means 70n is adapted to permit the level of sustained external force necessary to initiate movement of crosshead 70a to be changed even while vessel V is connected to inner boom I. It should be understood that control means 70n can be readily adapted to suit other levels of sustained external forces without departing from the spirit of the invention. It is preferred, for example, that pistons 70j have a stroke of as long as twenty feet for all cylinders 70b, 70c, 70f and 70g and that shock absorption means C have a capacity of 2,500 kips when resisting tensile forces applied by vessel V and a capacity of 500 kips in resisting compressive forces applied by vessel V on inner boom I.

Figure 4:
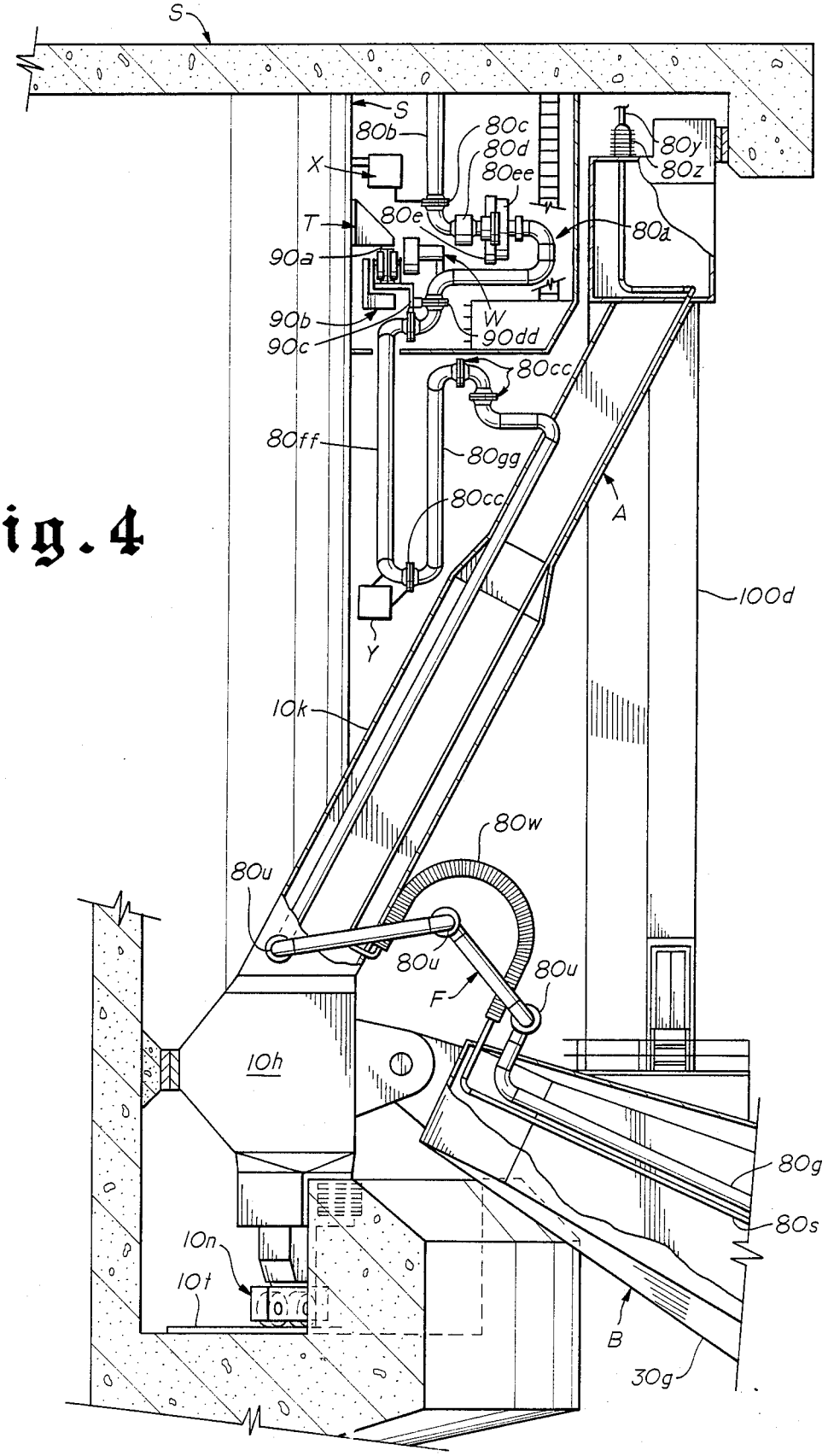
FIG. 4 is a cutaway sectional elevation of the A-frame showing the disposition of the fluid loading lines and fluid transfer lines therein.
Figure 5:
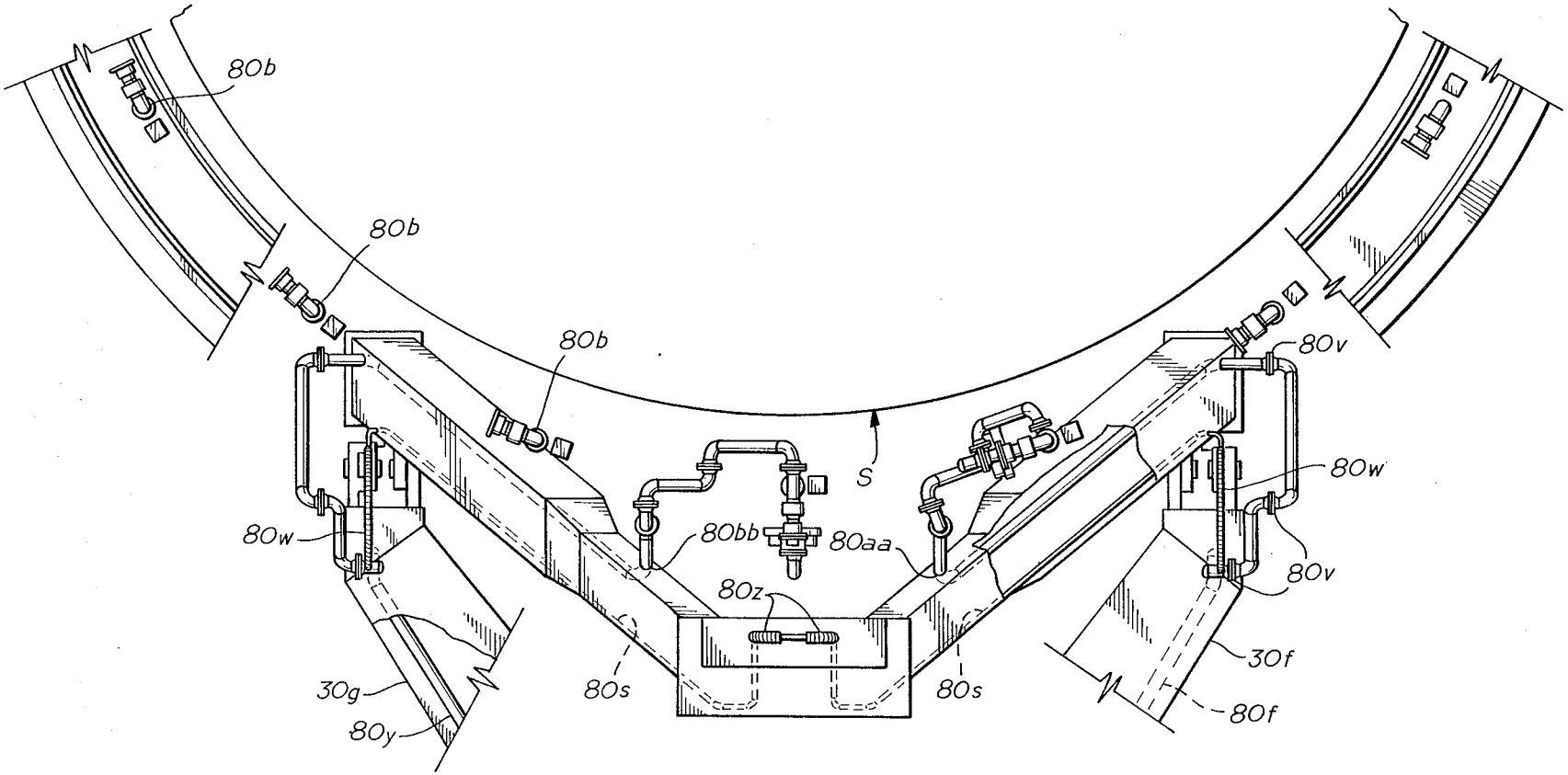
FIG. 5 is a plan view of the A-frame illustrating the coupling and decoupling of the fluid transfer lines to the outlets on the circular fluid loading header.

The transfer of fluids from offshore structure S to the vessel V and vice versa can begin once vessel V is moored to inner boom I. Fluid transfer means F includes a circular fluid loading header 80a located in an enclosure 100g (FIG. 2) secured to offshore structure S and connected to storage facilities on the platform (not shown). Circular fluid loading header 80a has a plurality of outlets 80b in fluid communication therewith (FIGS. 4 and 5). Each of said outlets 80b has a swivel joint 80c, shut off valve 80d and a coupling half 80e. As seen in FIGS. 8 and 9, a pair of fluid loading lines 80f and 80g extend from loading arm means J through the interior of inner boom I from position 42 to position 30j. Fluid loading lines 80f and 80g then continue in the interior space between inner boom and outer boom B whereupon line 80f has a pluarality of pairs of swivel joints 80i and line 80g has a similar number of pairs of swivel joints 80k nested between swivel joints 80i as shown in FIG. 8. As seen in FIG. 9, each pair of swivel joints 80i and 80k is independently supported within outer boom B for motion in a direction parallel to the longitudinal axis of outer boom B. Accordingly, when inner boom I telescopes into or out of outer boom B, the overall length of lines 80f and 80g can be extended or shortened, as needed, via the pairs of swivel joints 80i and 80k on lines 80f and 80g, respectively.

Referring now to FIG. 9, the piping between a pair of swivel joints 80i or 80k has an extension 80l which is adapted to engage track 80n for support throughout the range of movement within outer boom B. Although extension 80l is connected to one of lines 80f and 80g, in effect both lines are simultaneously supported due to a dummy pipe 80p having a swivel joint 80r therein. It is preferred that lines 80f and 80g be sixteen inch pipe although other sizes may be employed depending on the pumping rate desired into vessel V. At least one smaller, six inch, fluid transfer line 80s follows substantially the same path as lines 80f and 80g from loading arm means J to A-frame A. Since fluid transfer line S is of a smaller diameter than lines 80f and 80g the required flexibility for fluid transfer one 80s within outer boom B as a result of the telescoping motion of inner boom I can be provided for by using a flexible segment 80t (FIG. 9) which can be supported from the pairs of swivel joints 80i and 80k. Fluid transfer line 80s is used to pump diesel, water and other fluids from the vessel V onto the offshore structure S separately or in conjunction with the transfer of fluids from offshore structure S via lines 80f and 80g. This can alleviate the need for separate supply vessels.

As shown in FIG. 4, line 80g extends through leg 30g and via swivel joints 80u into the interior of A-frame A. Line 80f is similarly constructed and passes through leg 30f and enters the interior of A-frame A via pipe segments connected by swivel joints 80v (FIG. 5). Auxiliary fluid transfer lines 80s are employed, as shown in FIG. 5. Each auxiliary fluid transfer line 80s can extend through leg 30f or 30g and via a flexible segment 80w enter the interior of A-frame A. Upon emerging from adjacent the upper end 10c of A-frame A, auxiliary fluid transfer line 80s can be connected to a ring header (not shown) having a plurality of outlets 80y (FIG. 4) for transferring potable water and diesel fuel from the vessel V to the offshore structure S. Due to the intermittent nature of the operation of loading potable water and diesel fuel to the structure S, lines 80s must be manually disconnected and reconnected in the event vessel V weather vanes about structure S beyond a predetermined operational range causing A-frame A to move therewith. It is preferred to have at least two fluid transfer lines 80s with one dedicated to potable water service and the other for transferring diesel fuel and the like. Accordingly, a flexible segment 80z is provided to connect each line 80s to an outlet 80y (FIGS. 4 and 5).

As seen in FIG. 5 both lines 80f and 80g emerge from within A-frame A at points 80aa and 80bb, respectively. Thereafter, in order to allow lines 80f and 80g sufficient flexibility to remain connected to coupling half 80e as A-frame A travels on circular track 10t, both lines 80f and 80g employ a plurality of swivel joints 80cc (FIG. 4) disposed between the structure S and the inboard side 10k of A-frame A.

As shown in FIG. 4, shuttle means T is secured to the offshore structure S. Shuttle means T includes a circular track 90a upon which ride two motorized trolleys 90b each of which supports one of fluid loading lines 80f or 80g. One motorized trolley 90b is linked to line 80g via link 90c. Line 80f (not shown in FIG. 4) is similarly supported with the other trolley 90b. Riding with each motorized trolley 90b is alignment means W. Alignment means W is mounted to each motorized trolley 90b for independently rotating lines 80f or 80g about swivel joint 90dd. Although only line 80g is shown in FIG. 4, line 80f has a similar swivel joint 90dd which is operated by alignment means W connected to another motorized trolley 90b. Lines 80f and 80g each terminate in a coupling half 80ee (FIG. 4) which is designed to automatically mate and couple from coupling half 80e on each outlet 80b. Coupler means X with each outlet 80b selectively rotates swivel joint 80c for alignment between coupling half 80e and coupling half 80ee. Control means Y with each line 80f and 80g senses the angular deflection between pipe segment 80ff and 80gg (FIG. 4) to determine the opportune time for coupling or decoupling half 80ee from a given mating coupling half 80e. Although FIG. 5 shows lines 80f and 80g connected to adjoining outlets 80b, it is preferred that lines 80f and 80g be staggered so that there will be one unused outlet 80b between connected lines 80f and 80g.

With the vessel V connected to inner boom I and free to weathervane with respect to the offshore structure S, movement of A-frame A will cause angular displacement between pipe segments 80ff and 80gg on each of the connected lines 80f and 80g. Accordingly, it is preferred that as vessel V rotates in a given direction about the structure S that at the instant that one loading line, line, 80f for example, reaches its maximum extension, as represented by a preset angular deflection between segments 80ff and 80gg, that the other loading line 80g be at the point of least deflection as represented by segments 80ff and 80gg being disposed in the same vertical plane. In the event vessel V continues to weathervane in a given direction after control means Y has sensed that one of the connected lines 80f and 80g has reached its maximum extension, control means Y activates coupler means X and alignment means W thereby rotating coupling half 80e on the outlet 80b which is about to be disconnected from a loading line 80f or 80g. When coupler means X has oriented the coupling half 80e along a tangent line to the perimeter of structure S, further movement of A-frame A in the same direction causes coupler means X to close valve 80d and decouple coupling half 80e from coupling half 80ee. Upon decoupling, a given loading line 80f or 80g is driven by shuttle means T, as commanded by control means Y, to bring coupling half 80ee to the next adjacent coupling half 80e in the direction of motion of a A-frame A. When shuttle means T has brought coupling half 80ee close to the next adjacent coupling half 80e in the direction of motion of A-frame A, control means Y will allow alignment means W to orient coupling half 80ee and coupler means X to align coupling half 80e at the next adjacent outlet 80b so that a reconnection can be made. During the time shuttle means T drives line 80f or 80g with respect to A-frame A, the other loading line is still in service pumping fluids from the offshore structure S to the vessel V. Accordingly, with the angular displacement between segments 80ff and 80gg being sufficiently staggered, control means Y maintains one of loading lines 80f and 80g in service at all times. Coupling and decoupling of loading lines 80f and 80g and auxiliary line 80s is done within an enclosed structure 100g (FIG. 2) and is designed to be a dry-break insuring minimal spillage of the fluids transferred. The enclosure 100g minimizes icing on the connections and can retain spillage in an emergency to prevent pollution.

In an emergency situation requiring quick disconnection, loading arm means J can disconnect lines 80f, g, and s and rods 60g can be actuated to release elongated mating link E from vessel V after an audible and visual warning. Upon application of astern power the vessel V can move away from inner boom I.

Access is provided from structure S through ladder 100b (FIG. 2) into enclosure 100g. An operator may gain access into the top of A-frame A through a doorway (not shown) which allows access between enclosure 100h and enclosure 100c. Elevator 100e can be ridden down shaft 100d to gain access to platform 100f. From platform 100f access can be had to an opening in enclosed by leg 30g for access into the outer boom B. Using stair 100h (FIG. 9) personnel and equipment can be transferred from outer boom B to inner boom I. Additional platforms can be provided at the end of inner boom I to allow access to vessel V from inner boom I, thereby allowing vessel V to act as a personnel and consumables supply vessel.

The foregoing disclosure and description of the invention are illustrative and explanatory thereof, and various changes in the size, shape and materials, as well as in the details of the illustrated construction may be made without departing from the spirit of the invention.

We claim:

1. A mooring system for connecting a vessel having a mooring receptacle to a fixed noncompliant offshore structure comprising:

boom means mounted to said structure for establishing an extensible, semi-rigid coupling between the vessel and the structure, said boom means further comprising:

an outer boom pivotally mounted to the structure for movement in a plane parallel to the longitudinal axis of the offshore structure and for movement about the periphery of the structure in a plane perpendicular to the longitudinal axis of the structure;

an inner boom slidably mounted within said outer boom, and adapted for telescoping motion therewith in response to vessel movement;

said inner boom having an inboard end disposed within said outer boom, and an outboard end extending beyond said outer boom, said outboard end having an opening formed therein and adapted for contact with a mooring receptacle on the vessel;

luffing means for coarsely aligning said opening in said inner boom with the mooring receptacle of the vessel;

an elongated mating link retained by said inner boom and adapted for selective extension through said opening in said inner boom to engage the mooring receptacle on the vessel, said elongated mating link engaging said end of said inner boom so as to provide a pivotal mounting therebetween with respect to the longitudinal axis of said inner boom when said elongated link is extended through said opening in said inner boom;

shock absorption means with said inner and outer boom for dampening tensile and compressive forces exerted by the vessel on said inner boom in a direction parallel to the longitudinal axis of said inner boom; and whereby said inner boom remains in contact with the mooring receptacle on the vessel notwithstanding movement of the vessel.

2. The system of claim 1 further including:

means with the vessel for releasably engaging said elongated mating link.

3. The system of claim 2, wherein said shock absorption means further includes:

a crosshead mounted to the inboard end of said inner boom;

a compression pneumatic cylinder connected to said outer boom, having a piston rod extending therefrom and abutting said crosshead to resist compressive forces exerted by the vessel which tend to force said inner boom to telescope into said outer boom; and a tension pneumatic cylinder connected to said outer boom and having a piston rod extending therefrom and abutting said crosshead to resist tensile forces exerted by the vessel which tend to extend said inner boom from said outer boom.

4. The system of claim 3 wherein:

said tension and compression pneumatic cylinders each have a piston connected to said piston rod therein;

said piston rod in said tension and compression pneumatic cylinders each defines a cavity therein;

a compressible fluid disposed in said tension and compression pneumatic cylinders adjacent said piston therein;

whereupon the exercise of a tensile force by the vessel on said inner boom said piston, in said tensile pneumatic cylinder, compresses said compressible fluid therein into said cavity in said piston rod therein, and upon the exercise of a compressive force by the vessel on said inner boom said piston, in said compression cylinder compresses said compressible fluid therein into said cavity in said piston rod therein;

thereby allowing said tension and compression hydraulic cylinders to take the place of an external compressed fluid accumulator vessel outside of said tension and compression hydraulic cylinders.

5. The system of claim 4 wherein said shock absorption means further includes:

control means for selectively pressurizing said compressible fluid in both said tension and compression pneumatic cylinders thereby preventing movement of said piston in said tension and compression pneumatic cylinders until a preset sustained unidirectional force exerted by the vessel on said inner boom is attained, said control means allowing continuous adjustment of the dampening effect of said compression and tension pneumatic cyliders.

6. The system of claim 5 wherein:

said piston in said tension and compression pneumatic cylinders has a stroke length of as much as 20 feet.

7. The system of claim 6 wherein said elongated mating link further includes:

a first end adapted to be inserted into the mooring receptacle of the vessel further including:

connection means for allowing said releasable engagement means with said vessel to draw said vessel to said inner boom;

an engagement segment defining a step adjacent thereto, said releasable engagement means engaging said step adjacent said engagement segment to retain said elongated mating link to the vessel.

8. The system of claim 7 wherein said inner boom further includes:

a messenger line connected at a first end to said inner boom;

means for delivering a second end of said messenger line from said inner boom to the vessel; and, said releasable engagement means with the vessel further includes;

a pull in line adapted to be selectively connected to said messenger line and said connection means on said first end of said elongated mating link;

a traction winch for selectively reeling in or paying out said pull in line;

a chain stopper adapted to engage said step on said first end of said elongated mating link to retain said mating link to the vessel.

9. The system of claim 8 wherein:

the mooring receptacle on the vessel further comprises an opening formed on the bow of the vessel;

said elongated mating link further includes:

connection means adjacent a second end for selectively moving said elongated mating link with respect to said inner boom;

a spherical contact surface adjacent said second end defining a chord larger than said opening in said inner boom, thereby representing the outer travel stop of said elongated mating link with respect to said inner boom;

an elliptical section between said spherical contact surface and said engagement segment, to contact the bow of the vessel thereby facilitating alignment between said engagement segment of said elongated mating link and said chain stopper, as said elongated mating link enters the opening in the bow of the vessel due to the reeling in motion of said traction winch; and means with said inner boom selectively cooperating with said connection means adjacent said second end of said mating link for translating said spherical contact surface into and out of contact with said inner boom adjacent said opening therein and for pulling in said messenger line with said pull in line connected thereto.

10. The system of claim 9 wherein:

said elongated link can be pulled completely into said inner boom with said moving means disposed within said inner boom;

whereupon when said translating means is disabled and said pull-in line is connected to said connection means on said first end of said mating link, said traction winch can draw said mating link through said opening in said inner boom until said spherical contact surface is in contact with said inner boom whereupon said traction winch can draw the vessel toward said step on said mating link until said chain stopper can operably engage said step adjacent said engagement segment.

11. The system of claim 10 further including:

an A-frame mounted to the offshore structure and adapted to rotate 360 degrees about the longitudinal axis of the offshore structure;

said outer boom pivotally mounted to said A-frame, said luffing means mounted with said A-frame for pivoting said outer boom.

12. The system of claim 11 wherein said luffing means further includes:

a luffing winch, a plurality of pulleys disposed on said A-frame and said outer boom;

a plurality of ropes driven by said luffing winch over said pulleys for pivoting said outer boom with respect to said A-frame;

control means with said luffing winch for maintaining tensile force on said plurality of ropes in response to motions of the vessel which tends to slacken said ropes.

13. The system of claim 12 wherein said luffing means further includes:

a plurality of service cables selectively mounted in a first position wherein said cables are secured to said outer boom and a second position wherein said cables are connected between said pulleys on said A-frame and said outer boom thereby taking the weight of said outer boom off of said ropes driven by said luffing winch so that said driven ropes can be maintained and replaced.

14. The system of claim 13 wherein said luffing winch further includes:

a two speed gear box; and said control means selectively meshes the gears in said gearbox so that said luffing winch can pivot said outer boom faster when a vessel is connected thereto than when said plurality of ropes supports the weight of said inner and outer boom thereby increasing the responsiveness of said control means to any potential slack in said plurality of ropes.

15. The system of claim 14 further including:

a circular track disposed in said offshore structure in a plane perpendicular to the longitudinal axis of the offshore structure;

at least one bogie pivotally connected to the lower end of said A-frame said bogie having at least one axle with at least one wheel mounted thereto, said wheels in contact with said circular track;

said outer boom pivotally connected to said A-frame adjacent its lower end;

an upper continuous annular bearing pad between the upper end of said A-frame and the offshore structure;

a pair of lower continuous annular bearing pads adjacent said lower end of said A-frame and the offshore structure, said bogie on said A-frame being disposed between and beneath said pair of lower continuous bearing pads in a radial direction with respect to the motion of said A-frame.

16. The system of claim 15 further including:

a circular fluid loading header on the offshore structure having a plurality of outlets, each of said outlets terminating in a coupling pivotally mounted for rotation about an axis substantially parallel with the longitudinal axis of said offshore structure;

a plurality of fluid loading lines each having a coupling adapted to be selectively mated to the coupling on each outlets in said circular fluid loading header, said loading lines extending from adjacent said outlets in said circular fluid loading header, through said A-frame and said inner and outer booms to the outboard end of said inner boom;

an auxiliary fluid transfer line extending in a path adjacent to said fluid loading lines from the outboard end of said inner boom to adjacent the offshore structure for transferring fluids from the vessel to the offshore structure; and loading arm means for connecting said fluid loading lines and said auxiliary fluid transfer line between the outboard end of said outer boom to the vessel.

17. The system of claim 16 further including:

a plurality of swivel joints in each fluid loading line between said A-frame the offshore structure, thereby allowing each fluid loading line to remain connected to one of said outlets in said circular fluid loading header for a fixed displacement of said A-frame circumferentially about the offshore structure;

drive means with said bogie on said A-frame for selectively driving said A-frame along said circular track, said drive means adapted to be disabled when the vessel is connected to said inner boom, whereupon said vessel can direct the motion of said A-frame along said circular track;

coupler means with said outlets on said circular fluid loading header for automatically coupling and decoupling each said fluid loading lines to any of said outlets on said circular fluid loading header and for rotating each said outlets in said circular fluid loading header in conjunction with said coupling and decoupling;

shuttle means movably mounted to the offshore platform for independently moving each of said fluid loading lines circumferentially about the offshore structure faster than said A-frame, after said coupler means decouples each said fluid loading line from an outlet on said circular loading header; and alignment means movably mounted to said shuttle means for traveling with one of said swivel joints on each said fluid loading line, for operably rotating at least one of said swivel joints on each fluid loading line to facilitating alignment of said coupling on each of said fluid loading line to the next adjacent coupling on an outlet on said circular loading header approached by said shuttle means.

18. The system of claim 17 further including:

loading system control means mounted to the offshore structure for sensing the extension of each of said fluid loading lines adjacent said swivel joints and activating said coupler means, shuttle means and alignment means thereby preventing overextension of each said loading line due to movement of said A-frame along said circular track caused by the vessel connected to said outer boom; and said fluid loading lines are circumferentially staggered with respect to the motion of said A-frame thereby allowing said loading system control means to maintain at least one fluid loading line coupled to one of said outlets on said circular fluid loading header so that flow from the offshore structure to the vessel is not completely interrupted as the vessel weathervanes about the offshore structure.

19. The system of claim 18 wherein:

said fluid loading lines and said fluid transfer line extend substantially within said inner and outer boom and said A-frame thereby shielding said lines from environmental conditions adjacent the offshore structure.

20. The system of claim 19 wherein each fluid loading line further includes:

a plurality of pairs of swivel joints disposed within said outer boom each said pair of swivel joints supported by said outer boom for slidable motion in a direction parallel to the longitudinal axis of said outer boom, said pairs of swivel joints allowing compensation in the length of each said fluid loading line within said outer boom due to compressive and tensile forces exerted by the vessel on said inner boom in a direction parallel to the longitudinal axis of said inner boom.

21. The system of claim 20 further including:

a plurality of tracks mounted to said inner boom;

a plurality of bogies disposed in at least two spaced locations with respect to longitudinal axis of said outer boom, said bogies connected to said outer boom and each having at least one axle with at least one wheel mounted thereon, each of said wheels in rolling contact with one of said tracks on said inner boom thereby permitting said inner boom to telescope with respect to said outer boom.

22. The system of claim 21 wherein:

the outboard end of said inner boom is arcuate thereby allowing said inner boom to smoothly interact with the bow of the vessel in response to vessel movement.

23. The system of claim 2 wherein said elongated mating link further includes:

a first end adapted to be inserted into the mooring receptacle of the vessel further including:

connection means for allowing said releasable engagement means with said vessel to draw said vessel to said inner boom;

an engagement segment defining a step adjacent thereto, said releasable engagement means engaging said step adjacent said engagement segment to retain said elongated mating link to the vessel.

24. The system of claim 23 wherein said inner boom further includes:

a messenger line connected at a first end to said inner boom;

means for delivering a second end of said messenger line from said inner boom to the vessel; and, said releasable engagement means with the vessel further includes;

a pull in line adapted to be selectively connected to said messenger line and said connection means on said first end of said elongated mating link;

a traction winch for selectively reeling in or paying out said pull in line;

a chain stopper adapted to engage said step on said first end of said elongated mating link to retain said mating link to the vessel.

25. The system of claim 24 wherein:

the mooring receptacle on the vessel further comprises an opening formed on the bow of the vessel;

said elongated mating link further includes:

connection means adjacent a second end for selectively moving said elongated mating link with respect to said inner boom;

a spherical contact surface adjacent said second end defining a chord larger than said opening in said inner boom, thereby representing the outer travel stop of said elongated mating link with respect to said inner boom;

an elliptical section, between said spherical contact surface and said engagement segment, to contact the bow of the vessel thereby facilitating alignment between said engagement segment of said elongated mating link and said chain stopper, as said elongated mating link enters the opening in the bow of the vessel due to the reeling in motion of said traction winch; and means with said inner boom selectively cooperating with said connection means adjcent said second end of said mating link for translating said spherical contact surface into and out of contact with said inner boom adjacent said opening therein and for pulling in said messenger line with said pull in line connected thereto.

26. The system of claim 25 wherein:

said elongated link can be pulled completely into said inner boom with said moving means disposed within said inner boom;

whereupon when said translation means is disabled and said pull-in line is connected to said connection means on said first end of said mating link, said traction winch can draw said mating link through said opening in said inner boom until said spherical contact surface is in contact with said inner boom whereupon said traction winch can draw the vessel toward said step on said mating link until said chain stopper can operably engage said step adjacent said engagement segment.

27. The system of claim 2 further including:

a plurality of tracks mounted to said inner boom;

a plurality of bogies disposed in at least two spaced locations with respect to longitudinal axis of said outer boom, said bogies connected to said outer boom and each having at least one axle with at least one wheel mounted thereon, each of said wheels in rolling contact with one of said tracks on said inner boom thereby permitting said inner boom to telescope with respect to said outer boom.

28. The system of claim 2 further including:

an A-frame mounted to the offshore structure and adapted to rotate 360 degrees about the longitudinal axis of the offshore structure;

said outer boom pivotally mounted to said A-frame, said luffing means mounted with said A-frame for pivoting said outer boom.

29. The system of claim 28 wherein said luffing means further includes:

a luffing winch, a plurality of pulleys disposed on said A-frame and said outer boom;

a plurality of ropes driven by said luffing winch over said pulleys for pivoting said outer boom with respect to said A-frame;

control means with said luffing winch for maintaining tensile force on said plurality of ropes in response to motion of the vessel which tends to slacken said ropes.

30. The system of claim 29 wherein said luffing means further includes:

a plurality of service cables selectively mounted in a first position wherein said cables are secured to said outer boom and a second position wherein said cables are connected between said pulleys on said A-frame and said outer boom thereby taking the weight of said outer boom off of said ropes driven by said luffing winch so that said driven ropes can be maintained and replaced.

31. The system of claim 29 wherein said luffing winch further includes:

a two speed gear box; and said control means selectively meshes the gears in said gearbox so that said luffing winch can pivot said outer boom faster when a vessel is connected thereto than when said plurality of ropes supports the weight of said inner and outer boom thereby increasing the responsiveness of said control means to any potential slack in said plurality of ropes.

32. The system of claim 28 further including:

a circular track disposed in said offshore structure in a plane perpendicular to the longitudinal axis of the offshore structure;

at least one bogie pivotally connected to the lower end of said A-frame said bogie having at least one axle with at least one wheel mounted thereto, said wheels in contact with said circular track;

said outer boom pivotally connected to said A-frame adjacent its lower end;

an upper continuous annular bearing pad between the upper end of said A-frame and the offshore structure;

a pair of lower continuous annular bearing pads adjacent said lower end of said A-frame and the offshore structure, said bogie on said A-frame being disposed between and beneath said pair of lower continuous bearing pads in a radial direction with respect to the motion of said A-frame.

33. The system of claim 32 further including:

a circular fluid loading header on the offshore structure having a plurality of outlets, each of said outlets terminating in a coupling pivotally mounted for rotation about an axis substantially parallel with the longitudinal axis of said offshore structure;

a plurality of fluid loading lines each having a coupling adapted to be selectively mated to the coupling on each outlet in said circular fluid loading header, said loading lines extending from adjacent said outlets in said circular fluid loading header, through said A-frame and said inner and outer booms to the outboard end of said inner boom;

an auxiliary fluid transfer line extending in a path adjacent to said fluid loading lines from the outboard end of said inner boom to adjacent the offshore structure for transferring fluids from the vessel to the offshore structure; and loading arm means for connecting said fluid loading lines and said auxiliary fluid transfer line between the outboard end of said outer boom to the vessel.

34. The system of claim 33 further including:

a plurality of swivel joints in each fluid loading line between said A-frame and the offshore structure, thereby allowing each fluid loading line to remain connected to one of said outlets in said circular fluid loading header for a fixed displacement of said A-frame circumferentially about the offshore structure;

drive means with said bogie on said A-frame for selectively driving said A-frame along said circular track, said drive means adapted to be disabled when the vessel is connected to said inner boom, whereupon said vessel can direct the motion of said A-frame along said circular track;

coupler means with said outlets on said circular fluid loading header for automatically coupling and decoupling each said fluid loading lines to any of said outlets on said circular fluid loading header and for rotating each said outlets in said circular fluid loading header in conjunction with said coupling and decoupling;

shuttle means movably mounted to the offshore platform for independently moving each of said fluid loading lines circumferentially about the offshore structure faster than said A-frame, after said coupler means decouples each said fluid loading line from an outlet on said circular loading header; and alignment means movably mounted to said shuttle means for traveling with one of said swivel joints on each said fluid loading line, for operably rotating at least one of said swivel joints on each said fluid loading line, thereby facilitating alignment of said coupling on each of said fluid loading line to the next adjacent coupling on an outlet on said circular loading header approached by said shuttle means.

35. The system of claim 34 further including:

loading system control means mounted to the offshore structure for sensing the extension of each of said fluid loading lines adjacent said swivel joints and activating said coupler means, shuttle means and alignment means thereby preventing overextension of each said loading line due to movement of said A-frame along said circular track caused by the vessel connected to said outer boom; and said fluid loading lines are circumferentially staggered with respect to the motion of said A-frame thereby allowing said loading system control means to maintain at least one fluid loading line coupled to one of said outlets on said circular fluid loading header so that flow from the offshore structure to the vessel is not completely interrupted as the vessel weathervanes about the offshore structure.

36. The system of claim 35 wherein:

said fluid loading lines and said fluid transfer line extend substantially within said inner and outer boom and said A-frame thereby shielding said lines from environmental conditions adjacent the offshore structure.

37. The system of claim 36 wherein each fluid loading line further includes:

a plurality of pairs of swivel joints disposed within said outer boom each said pair of swivel joints supported by said outer boom for slidable motion in a direction parallel to the longitudinal axis of said outer boom, said pairs of swivel joints allowing compensation in the length of each said fluid loading line within said outer boom due to compressive and tensile forces exerted by the vessel on said inner boom in a direction parallel to the longitudinal axis of said inner boom.

38. The system of claim 1 wherein:

the outboard end of said innner boom is arcuate thereby allowing said inner boom to smoothly interact with the bow of the vessel in response to vessel movement.

* * * * *

UNITED STATES PATENT AND TRADEMARK OFFICE

CERTIFICATE OF CORRECTION

PATENT NO. : 4,735,167

DATED : April 5, 1988

INVENTOR(S) : Geoff C. White and Costas P. Manoudakis

It is certified that error appears in the above-identified patent and that said Letters Patent is hereby corrected as shown below: On the title page:

In the Abstract, line 18, insert --,-- after "extension".

At Column 1, line 40, change "llmitation" to --limitation--.

At Column 3, line 57, change "," to --;--.

At Column 4, line 65, change "againset" to --against--.

At Column 5, line 48, change "provlded" to --provided--.

At Column 6, line 19, change "sprit" to --spirit--.

At Column 7, line 68, change "30M" to --30M,--.

At Column 8, line 50, change "substantiallY" to --substantially--.

At Column 9, line 9, change "a" to --an--.

At Column 9, line 36, change "mounting" to --mating--.

At Column 13, line 47, omit "line,".

At Column 13, line 67, change "a" to --an--.

Signed and Sealed this

Eighth Day of November, 1988

*Attest:*

*Attesting Officer*

DONALD J. QUIGG

*Commissioner of Patents and Trademarks*